US008808506B2

(12) United States Patent
Quigley

(10) Patent No.: US 8,808,506 B2
(45) Date of Patent: Aug. 19, 2014

(54) STRUCTURED FABRIC FOR USE IN A PAPERMAKING MACHINE AND THE FIBROUS WEB PRODUCED THEREON

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/371,742

(22) Filed: Feb. 13, 2012

(65) Prior Publication Data

US 2013/0206347 A1 Aug. 15, 2013

(51) Int. Cl.

| | |
|---|---|
| ***D21F 1/10*** | (2006.01) |
| ***D21F 9/00*** | (2006.01) |
| ***D21H 27/02*** | (2006.01) |
| ***D21F 11/14*** | (2006.01) |
| ***D03D 25/00*** | (2006.01) |

(52) U.S. Cl.

USPC ..... 162/348; 162/116; 162/296; 162/362; 162/903; 139/383 A

(58) Field of Classification Search

CPC ..... D21F 11/00; D21F 11/06; D21F 11/14; D21F 11/145; D21F 1/10; D21F 1/105; D21F 1/0027; D21F 9/00; D21F 9/003; D21H 27/02; D03D 3/04; D03D 13/004; D03D 25/00

USPC ..... 162/348, 902, 903, 904, 116, 362, 203, 162/296, 300, 301, 361; 139/383 A, 425 A

See application file for complete search history.

(56) References Cited

U.S. PATENT DOCUMENTS

| | | | | |
|---|---|---|---|---|
| 4,528,239 | A | 7/1985 | Trokhan | |
| 5,429,686 | A | 7/1995 | Chiu et al. | |
| 5,465,764 | A * | 11/1995 | Eschmann et al. | 139/383 A |
| 6,237,644 | B1 | 5/2001 | Hay et al. | |
| 6,649,026 | B2 | 11/2003 | Lamb | |
| 7,585,395 | B2 * | 9/2009 | Quigley et al. | 162/358.4 |
| 7,600,538 | B2 * | 10/2009 | Einarsson | 139/383 AA |
| 2004/0035541 | A1 * | 2/2004 | Lamb | 162/348 |

FOREIGN PATENT DOCUMENTS

| | | | |
|---|---|---|---|
| EP | 1837439 | A2 | 9/2007 |
| WO | 2005073461 | A1 | 8/2005 |
| WO | PCTEP2004053688 | A2 | 8/2005 |
| WO | PCTEP2005050198 | A2 | 8/2005 |
| WO | 2009069046 | A1 | 6/2009 |
| WO | 2010069695 | A1 | 6/2010 |

* cited by examiner

*Primary Examiner* — Eric Hug
(74) *Attorney, Agent, or Firm* — Taylor IP, P.C.

(57) ABSTRACT

A papermaking machine for the production of a fibrous web including a plurality of rollers and a structured fabric moving along the rollers. The structured fabric includes a plurality of weft yarns and a plurality of warp yarns woven with the plurality of weft yarns to produce a weave pattern, the plurality of warp yarns being a plurality of paired warp yarn sets. Each paired warp yarn set including a first warp yarn and a second warp yarn. Within the weave pattern the first warp yarn forms a float over at least four weft yarns and weaves with a single weft yarn immediately adjacent with the float. The second warp yarn having an inverse pattern to the first warp yarn, with the second warp yarn weaving with another single weft yarn that is not adjacent to the single weft yarn with which the first warp yarn is woven.

17 Claims, 10 Drawing Sheets

STRUCTURED FABRIC FOR USE IN A PAPERMAKING MACHINE AND THE FIBROUS WEB PRODUCED THEREON

BACKGROUND OF THE INVENTION

1. Field of the Invention

The present invention relates generally to papermaking, and relates more specifically to a structured fabric employed in a papermaking machine for the production of a fibrous web and the fibrous web manufactured thereby, the fibrous web being tissue or toweling.

2. Description of the Related Art

In a conventional papermaking process, a water slurry, or suspension, of cellulosic fibers (known as the paper "stock") is fed into a gap between two endless woven wires that travels between two or more rolls. At least one of the wires are often referred to as a "structured fabric" that provides a papermaking surface on the upper surface of its upper run which operates as a filter to separate the cellulosic fibers of the paper stock from the aqueous medium, thereby forming a wet paper web. The aqueous medium drains through mesh openings of the structured fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermakers' fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermakers' fabric, the warp yarns extend in the machine direction and the filling or weft yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the structured fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and the like) the papermaking surface comprises a very finely woven or fine wire mesh structure.

In a conventional tissue forming machine, the sheet is formed flat. At the press section, 100% of the sheet is pressed and compacted to reach the necessary dryness and the sheet is further dried on a Yankee and hood section. The sheet is then creped and wound-up, thereby producing a flat sheet.

In an ATMOS™ system, a sheet is formed on a structured or molding fabric and the sheet is further sandwiched between the structured or molding fabric and a dewatering fabric. The sheet is dewatered through the dewatering fabric and opposite the molding fabric. The dewatering takes place with airflow and mechanical pressure. The mechanical pressure is created by a permeable belt and the direction of air flow is from the permeable belt to the dewatering fabric. This can occur when the sandwich passes through an extended pressure nip formed by a vacuum roll and the permeable belt. The sheet is then transferred to a Yankee by a press nip. Only about 25% of the sheet is slightly pressed by the Yankee while approximately 75% of the sheet remains unpressed for quality. The sheet is dried by a Yankee/Hood dryer arrangement and then dry creped. In the ATMOS™ system, one and the same structured fabric is used to carry the sheet from the headbox to the Yankee dryer. Using the ATMOS™ system, the sheet reaches between about 35 to 38% dryness after the ATMOS™ roll, which is almost the same dryness as a conventional press section. However, this advantageously occurs with almost 40 times lower nip pressure and without compacting and destroying sheet quality. Furthermore, a big advantage of the ATMOS™ system is that it utilizes a permeable belt which is highly tensioned, e.g., about 60 kN/m. This belt enhances the contact points and intimacy for maximum vacuum dewatering. Additionally, the belt nip is more than 20 times longer than a conventional press and utilizes airflow through the nip, which is not the case on a conventional press system.

Actual results from trials using an ATMOS™ system have shown that the caliper and bulk of the sheet is 30% higher than the conventional through-air drying (TAD) formed towel fabrics. Absorbency capacity is also 30% higher than with conventional TAD formed towel fabrics. The results are the same whether one uses 100% virgin pulp up to 100% recycled pulp. Sheets can be produced with basis weight ratios of between 14 to 40 g/m$^2$. The ATMOS™ system also provides excellent sheet transfer to the Yankee working at 33 to 37% dryness. A key aspect of the ATMOS™ system is that it forms the sheet on the molding fabric and the same molding fabric carries the sheet from the headbox to the Yankee dryer. This produces a sheet with a uniform and defined pore size for maximum absorbency capacity.

U.S. Pat. No. 7,585,395 to Quigley, the disclosure of which is hereby expressly incorporated by reference in its entirety, discloses a structured fabric for an ATMOS™ system. The fabric utilizes an at least three float warp and weft structure, in a symmetrical form.

U.S. Pat. No. 5,429,686 to Chiu et al., the disclosure of which is hereby expressly incorporated by reference in its entirety, discloses structured forming fabrics which utilize a load-bearing layer and a sculptured layer. The fabrics utilize impression knuckles to imprint the sheet and increase its surface contour. This document, however, does not create pillows in the sheet for effective dewatering of TAD applications, nor does it teach using the disclosed fabrics on an ATMOS™ system and/or forming the pillows in the sheet while the sheet is relatively wet and utilizing a hi-tension press nip.

What is needed in the art is an efficient effective single layer fabric weave pattern to be used in a papermaking machine.

SUMMARY OF THE INVENTION

In one aspect, the invention provides a papermaking machine for the production of a fibrous web. The papermaking machine for the production of a fibrous web. The papermaking machine including a plurality of rollers and a structured fabric moving along the plurality of rollers. The structured fabric includes a plurality of weft yarns and a plurality of warp yarns woven with the plurality of weft yarns to produce a weave pattern, the plurality of warp yarns being a plurality of paired warp yarn sets. Each paired warp yarn set including a first warp yarn and a second warp yarn. Within the weave pattern the first warp yarn forms a float over at least four weft yarns and weaves with a single weft yarn immediately adjacent with the float. The second warp yarn having an inverse pattern to the first warp yarn, with the second warp yarn weaving with another single weft yarn that is not adjacent to the single weft yarn with which the first warp yarn is woven.

In another aspect, the invention is a structured fabric for use in a papermaking machine to produce a fibrous web. The structured fabric includes a plurality of weft yarns and a plurality of warp yarns woven with the plurality of weft yarns to produce a weave pattern. The plurality of warp yarns being a plurality of paired warp yarn sets. Each paired warp yarn set includes a first warp yarn and a second warp yarn. Within the weave pattern the first warp yarn forms a float over at least four weft yarns and weaves with a single weft yarn immediately adjacent with the float. The second warp yarn having an inverse pattern to the first warp yarn, with the second warp yarn weaving with another single weft yarn that is not adjacent to the single weft yarn with which the first warp yarn is woven.

In yet another aspect the invention provides a fibrous web having a fibrous construct with at least one formed surface feature. The surface feature includes a topographical pattern reflective of a weave pattern in a structured fabric used in a papermaking machine, the structured fabric having a machine facing side and a web facing side. The structured fabric includes a plurality of weft yarns and a plurality of warp yarns woven with the plurality of weft yarns to produce a weave pattern. The plurality of warp yarns being a plurality of paired warp yarn sets. Each paired warp yarn set includes a first warp yarn and a second warp yarn. Within the weave pattern the first warp yarn forms a float over at least four weft yarns and weaves with a single weft yarn immediately adjacent with the float. The second warp yarn having an inverse pattern to the first warp yarn, with the second warp yarn weaving with another single weft yarn that is not adjacent to the single weft yarn with which the first warp yarn is woven.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, and the description is taken with the drawings making apparent to those skilled in the art how the forms of the present invention may be embodied in practice.

The present invention relates to a structured fabric for a papermaking machine, a former for manufacturing a paper web, and also to a former which utilizes the structured fabric, and in some embodiments a belt press, in a papermaking machine, and the fibrous web manufactured thereby.

The present invention also relates to a twin wire former ATMOS™ system which utilizes the structured fabric which has good resistance to pressure and excessive tensile strain forces, and which can withstand wear/hydrolysis effects that are experienced in an ATMOS™ system. The system may also include a permeable belt for use in a high tension extended nip around a rotating roll or a stationary shoe and a dewatering fabric for the manufacture of premium tissue or towel grades. The fabric has key parameters which include permeability, weight, caliper, and certain compressibility.

Figure 1:
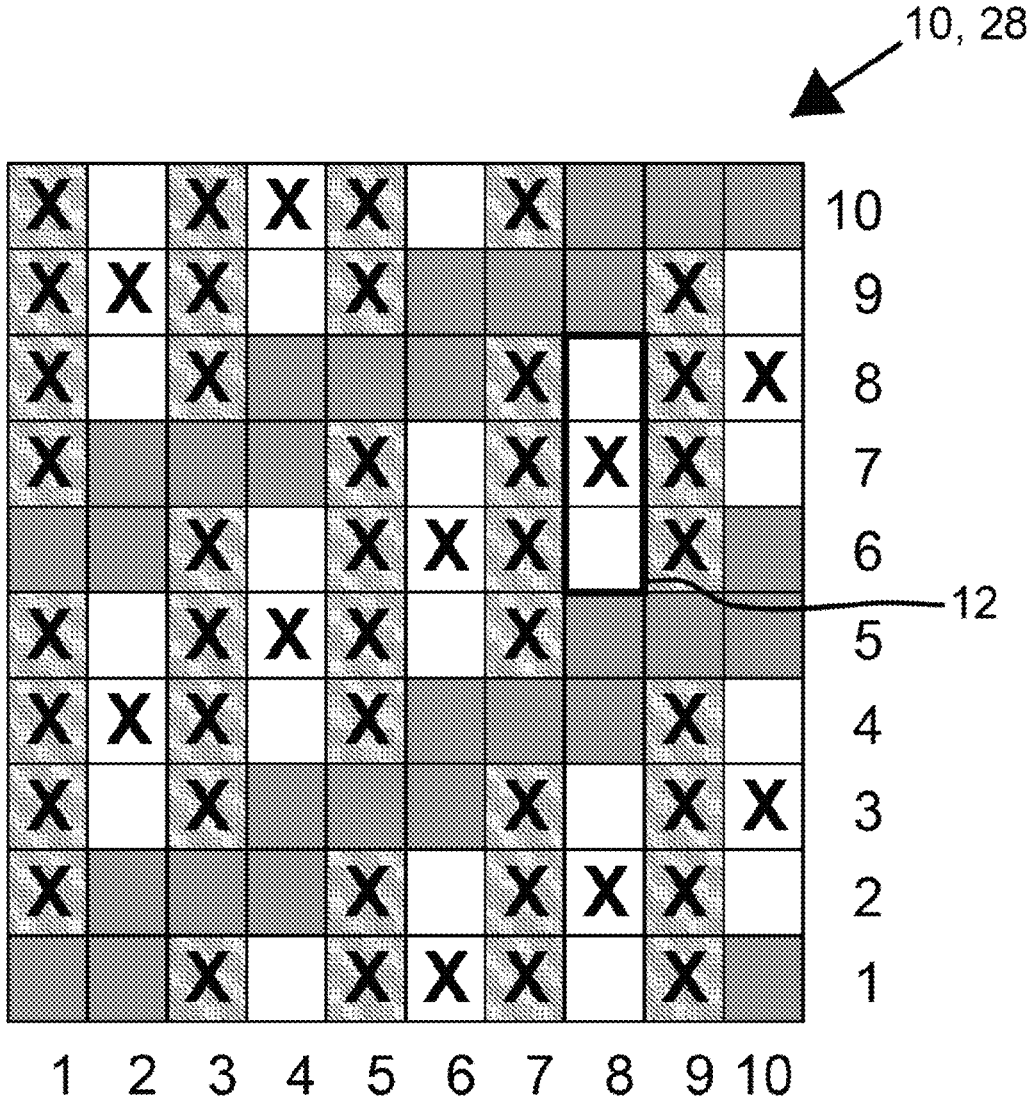
FIG. 1 shows a repeating weave pattern from the top side, or web facing side, of an embodiment of a structured fabric of the present invention, each 'X' indicating a location where a warp yarn passes over a weft yarn.
Figure 2:
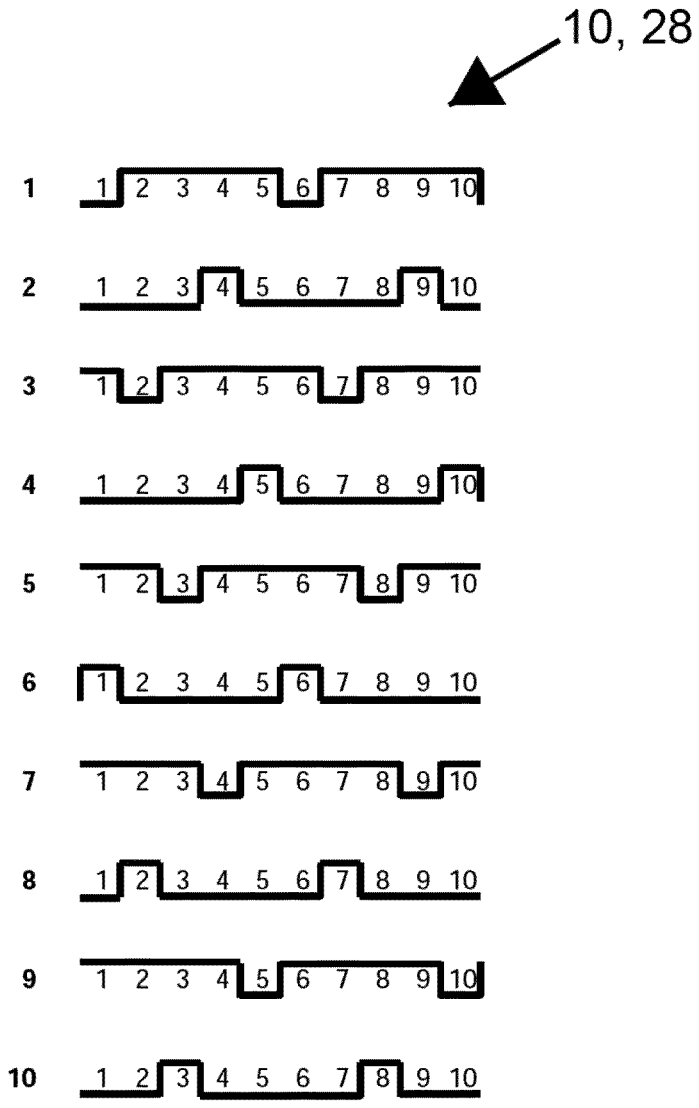
FIG. 2 illustrates the repeating weave pattern of the warp yarns of the embodiment of FIG. 1.
Figure 3:
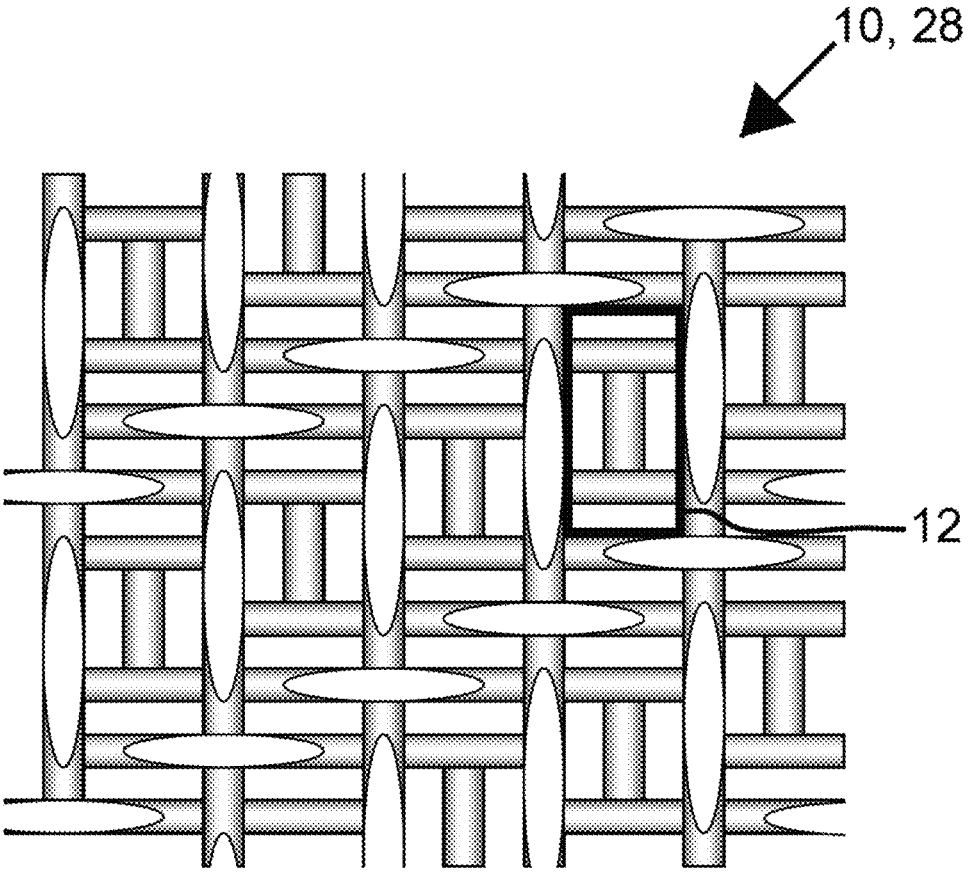
FIG. 3 shows a surface motif of the weave pattern of FIGS. 1 and 2.

Weave pattern 10 of structured fabric 28 of the present invention is illustrated in FIGS. 1-3. FIG. 1 depicts a weave pattern 10 from a top pattern view of the web facing side of the fabric, also known as the papermaking surface. The numbers 1-10, shown on the bottom of the pattern identify the warp, machine direction (MD) yarns, while the right side numbers 1-10 show the weft, cross direction (CD) yarns. The symbol 'X' illustrates a location where a warp yarn passes over a weft yarn and a box without an 'X' illustrates a location where a warp yarn passes under a weft yarn. As shown in FIG. 1, the areas that are shaded also having an 'X' therein indicates long float warp yarns, which float over at least four weft yarns. The shaded areas not having an X illustrates weft yarns that are on top of warp yarns in structured fabric 28. The non-shaded areas represent pocket areas 12, with the 'X' in the pocket area indicating a warp yarn that is at a lower level than the immediately adjacent warp yarns, because this warp yarn is woven with weft yarns on each side of the warp yarn where the 'X' is located in the unshaded pocket areas.

FIG. 2 illustrates the weave pattern of the warp yarns relative to the weft yarns with the weft yarns being represented in each line as the numbers and with the numbered line (1-10 arranged vertically) being the pattern of the warp yarns. Each line represents the warp yarn identified along the left side of the FIG.

Referring now to FIG. 3 there is an illustration of what weave pattern 10 produces within structured fabric 28. The pattern of the web formed on fabric 28 will be a substantial reflection of the pattern illustrated herein. Both FIGS. 1 and 3 have an example pocket area 12 boldly outlined schematically as a rectangular shape.

Topographical features of weave pattern 10 are repeated in structured fabric 28 and are reflected upon web 38, as web 38 is produced in the papermaking machine. The topographical features cause a three-dimensional effect in web 38 reflective of weave pattern 10, which enhances web 38 and imparts characteristics to web 38, such as pocket depth and texture.

The warp yarns interact with the weft yarns to produce weave patterns 10. Each set of two warp yarns can be thought of as a paired warp yarn set with the warp yarns having an inverse offset pattern.

Adjacent floats, which are the floats that occur adjacent to another float, with one intervening warp yarn between them, have starts and finishes that are offset by one weft yarn, which defines what is referred to herein as a "float offset." By this definition adjacent floats will occur associated with the odd numbered warp yarns. The float offsets of the starts and the float offsets of the finishes are in the same direction. For example, in FIGS. 1-3, the floats that occurs with warp yarns 1 and 3 have the starts and the finishes each offset in the same direction. For the sake of convenience a start can be considered to occur at the lower numbered weft yarn at which the float begins and the finish being the higher number weft yarn where the float ends. So, the float of warp yarn 1 starts with weft yarn 2, and finishes with weft yarn 5. The adjacent float of warp yarn 3 starts with weft yarn 3 and finishes with weft yarn 6, hence the float offset occurs on both the start and finish and the offsets are in the same direction, with the number of the weft yarns both being incremented by one as one goes from warp yarn 1 to warp yarn 3. It should be noted that each odd numbered warp yarn float will have an adjacent odd numbered warp yarn float offset by one for each warp yarn float.

Structured fabric 28 includes ten weft yarns and ten warp yarns woven with the weft yarns to produce weave pattern 10. The ten warp yarns may be grouped into five pairs of warp yarn sets. Each paired warp yarn set includes a first warp yarn and an adjacent second warp yarn. Within weave pattern 10 the first warp yarn floats over at least four weft yarns and weaves with a singular weft yarn. The second warp yarn has an inverse pattern to the first warp yarn, which is a way of saying when viewed from an opposite side of weave pattern 10. The second warp yarn weaves with a singular weft yarn that is not adjacent to the singular weft yarn with which the first warp yarn is woven.

Structured fabric 28 can also be treated and/or coated with an additional polymeric material that is applied by, e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduced drive loads. The treatment/coating can be applied to impart/improve one or several of these properties of the fabric. The topographical pattern in the paper web can be changed and manipulated by use of adjustments to the specific fabric weave by changes to the yarn diameter, yarn counts, yarn types, yarn shapes, permeability, caliper and the addition of a treatment or coating etc. In addition, a printed design, such as a screen-printed design, of polymeric material can be applied to the fabric to enhance its ability to impart an aesthetic pattern into the web or to enhance the quality of the web. Finally, one or more surfaces of the fabric or molding belt can be subjected to sanding and/or abrading in order to enhance surface characteristics.

The characteristics of the individual yarns utilized in the fabric of the present invention can vary depending upon the desired properties of the final papermakers' fabric. For example, the materials comprising yarns employed in the fabric of the present invention may be those commonly used in papermakers' fabric. As such, the yarns may be formed of polypropylene, polyester, nylon, or the like. The skilled artisan should select a yarn material according to the particular application of the final fabric.

The yarns may have differing dimensions and shapes relative to adjacent yarns to thereby alter the size of the pocket areas. One of the pocket areas 12 is illustrated in FIGS. 1 and 3 as a darkened border and this one pocket area is representative of the others that occur across weave pattern 10. Based on many factors the size of the pocket area can be altered. For example if warp yarns 7 and 9 are larger than warp yarn 8, then the proportional width of the pocket area will be narrower, and proportionally deeper.

Some characteristics of the warp and weft yarns include various cross-sections, such as circular, elliptical, polygonal, rectangular and square. The meshes and yarn counts can be from 10 to 100 and more particularly between 26 and 86. The yarn cross-sectional dimensions can vary from 0.10 mm to 1.0 mm, and more particularly between 0.30 mm and 0.45 mm. The number of pocket areas per square inch can be from 50 to 500 and more particularly between 150 to 300. The permeability of fabric 28 may be from 100 to 1,000 cubic feet per minute (CFM) per $ft^2$, and more particularly between 350 and 700 CFM.

The paper that results from the forming process using the inventive fabric has desirable attributes. Those attributes include a basis weight in the range of 17-19.5 $gm/m^2$, a caliper of 0.45 to 0.49 mm, a bulk of 22 to 27 $cm^3/gm$, a machine direction gram force per 50 mm of between 900 and 1300 gm, a cross-machine direction gram force per 50 mm of between 500 and 700 gm, a machine direction stretch of 9-15%, and an absorbency of 15-18 gm of water/gm of paper.

By way of a non-limiting example, the structured fabric is a single-layered woven fabric which can withstand high pressures, heat, moisture concentrations, and which can achieve a high level of water removal and also mold or emboss the paper web. These characteristics provide a structured fabric appropriate for the Voith ATMOS™ papermaking process. The fabric preferably has a width stability and a suitable high permeability and preferably utilizes hydrolysis and/or temperature resistant materials, as discussed above. The fabric is preferably a woven fabric that can be installed on an ATMOS™ machine as a pre-joined and/or seamed continuous and/or endless belt. Alternatively, the structured fabric can be joined in the ATMOS™ machine using, e.g., a pin-seam arrangement or can otherwise be seamed on the machine.

The invention also provides for utilizing the structured fabric disclosed herein on a machine for making a fibrous web, e.g., tissue or hygiene paper web, etc., which can be, e.g., a twin wire or a permeable belt ATMOS™ system. Referring again to the drawings, and more particularly to FIGS. 4-10, there is a fibrous web machine including a headbox 22 that discharges a fibrous slurry between a forming fabric 26 and a structured fabric 28 having a weave pattern 10. It should be understood that structured fabric 28 is an embodiment of the structured fabric discussed above in connection with FIGS. 1-28. Rollers 30 and 32 direct fabric 26 in such a manner that tension is applied thereto, against slurry 24 and structured fabric 28. Structured fabric 28 is supported by forming roll 34 which rotates with a surface speed that matches the speed of structured fabric 28 and forming fabric 26. Structured fabric 28 has peaks and valleys as defined by weave pattern 10, which give a corresponding structure to web 38 formed thereon. Structured fabric 28 travels in a web direction, and as moisture is driven from the fibrous slurry, structured fibrous web 38 takes form. The moisture that leaves the slurry travels through forming fabric 26.

The fibrous slurry is formed into a web 38 with a structure that matches the shape of structured fabric 28. Forming fabric 26 is porous and allows moisture to escape during forming. Further, water is removed through dewatering fabric 82. The removal of moisture through fabric 82 does not cause compression of web 38 traveling on structured fabric 28.

Due to the formation of the web 38 with the structured fabric 28 the pockets of the fabric 28 are fully filled with fibers. Therefore, at the Yankee surface 52 the web 38 has a much higher contact area, up to approximately 100%, as compared to the prior art because the web 38 on the side contacting the Yankee surface 52 is almost flat.

Figure 4:
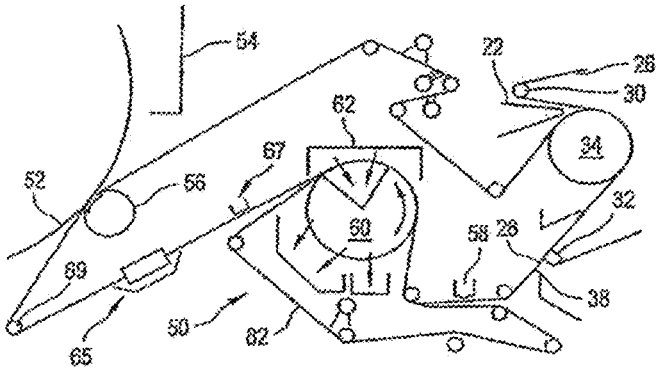
FIG. 4 illustrates a schematic cross-sectional view of an embodiment of an ATMOS™ papermaking machine.

Referring to FIG. 4, there is shown an embodiment of the process where a structured fibrous web 38 is formed. Structured fabric 28 carries a three dimensional structured fibrous web 38 to an advanced dewatering system 50, past vacuum box 67 and then to a position where the web is transferred to Yankee dryer 52 and hood section 54 for additional drying and creping before winding up on a reel (not shown).

A shoe press 56 is placed adjacent to structured fabric 28, holding fabric 28 in a position proximate Yankee dryer 52. Structured fibrous web 38 comes into contact with Yankee dryer 52 and transfers to a surface thereof, for further drying and subsequent creping.

A vacuum box 58 is placed adjacent to structured fabric 28 to achieve improved solids levels. Web 38, which is carried by structured fabric 28, contacts dewatering fabric 82 and proceeds toward vacuum roll 60. Vacuum roll 60 operates at a vacuum level of −0.2 to −0.8 bar with a preferred operating level of at least −0.4 bar. Hot air hood 62 is optionally fit over vacuum roll 60 to improve dewatering.

Optionally a steam box can be installed instead of the hood 62 supplying steam to the web 38. The steam box preferably has a sectionalized design to influence the moisture re-dryness cross profile of the web 38. The length of the vacuum zone inside the vacuum roll 60 can be from 200 mm to 2,500 mm, with a preferable length of 300 mm to 1,200 mm and an even more preferable length of between 400 mm to 800 mm. The solids level of web 38 leaving suction roll 60 is 25% to 55% depending on installed options. A vacuum box 67 and hot air supply 65 can be used to increase web 38 solids after vacuum roll 60 and prior to Yankee dryer 52. Wire turning roll 69 can also be a suction roll with a hot air supply hood. As discussed above, roll 56 includes a shoe press with a shoe width of 80 mm or higher, preferably 120 mm or higher, with a maximum peak pressure of less than 2.5 MPa. To create an even longer nip to facilitate the transfer of web 38 to Yankee dryer 52, web 38 carried on structured fabric 28 can be brought into contact with the surface of Yankee dryer 52 prior to the press nip associated with shoe press 56. Further, the contact can be maintained after structured fabric 28 travels beyond press 56.

Figure 5:
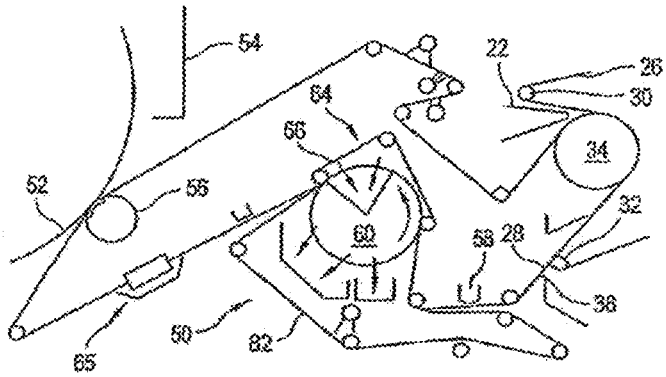
FIG. 5 illustrates a schematic cross-sectional view of another embodiment of an ATMOS™ papermaking machine.

Now, additionally referring to FIG. 5, there is shown yet another embodiment of the present invention, which is substantially similar to the invention illustrated in FIG. 4, except that instead of hot air hood 62, there is a belt press 64. Belt press 64 includes a permeable belt 66 capable of applying pressure to the machine side of structured fabric 28 that carries web 38 around vacuum roll 60. Fabric 66 of belt press 64 is also known as an extended nip press belt or a link fabric, which can run at 60 KN/m fabric tension with a pressing length that is longer than the suction zone of roll 60.

Preferred embodiments of the fabric 66 and the required operation conditions are also described in PCT/EP2004/053688 and PCT/EP2005/050198 which are herewith incorporated by reference.

The above mentioned references are also fully applicable for dewatering fabrics 82 and press fabrics 66 described in the further embodiments.

Belt 66 is a specially designed extended nip press belt 66, made of, for example reinforced polyurethane and/or a spiral link fabric. Belt 66 also can have a woven construction. Such a woven construction is disclosed, e.g., in EP 1837439. Belt 66 is permeable thereby allowing air to flow there through to enhance the moisture removing capability of belt press 64. Moisture is drawn from web 38 through dewatering fabric 82 and into vacuum roll 60.

Figure 6:
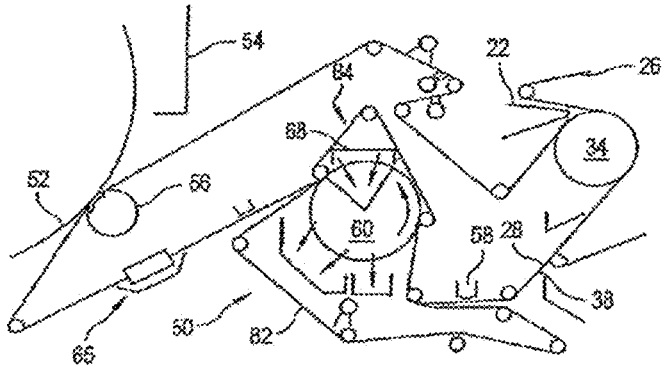
FIG. 6 illustrates a schematic cross-sectional view of another embodiment of an ATMOS™ papermaking machine.

Referring to FIG. 6, there is shown another embodiment of the present invention which is substantially similar to the embodiment shown in FIG. 5 with the addition of hot air hood 68 placed inside of belt press 64 to enhance the dewatering capability of belt press 64 in conjunction with vacuum roll 60.

Figure 7:
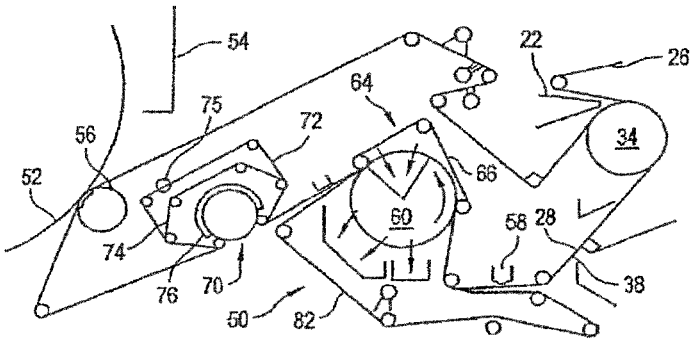
FIG. 7 illustrates a schematic cross-sectional view of another embodiment of an ATMOS™ papermaking machine.

Referring to FIG. 7, there is shown yet another embodiment of the present invention, which is substantially similar to the embodiment shown in FIG. 5, but including a boost dryer 70 which encounters structured fabric 28. Web 38 is subjected to a hot surface of boost dryer 70, and structured web 38 rides around boost dryer 70 with another woven fabric 72 riding on top of structured fabric 28. On top of woven fabric 72 is a thermally conductive fabric 74, which is in contact with both woven fabric 72 and a cooling jacket 76 that applies cooling and pressure to all fabrics and web 38. The pressing process does not negatively impact web quality. The drying rate of boost dryer 70 is above 400 kg/hr $m^2$ and preferably above 500 kg/hr $m^2$. The concept of boost dryer 70 is to provide sufficient pressure to hold web 38 against the hot surface of the dryer thus preventing blistering. Steam that is formed at the knuckle points of fabric 28 passes through fabric 28 and is condensed on fabric 72. Fabric 72 is cooled by fabric 74 that is in contact with cooling jacket 76, which reduces its temperature to well below that of the steam. Thus the steam is condensed to avoid a pressure build up to thereby avoid blistering of web 38. The condensed water is captured in woven fabric 72, which is dewatered by dewatering device 75. It has been shown that depending on the size of boost dryer 70, the need for vacuum roll 60 can be eliminated. Further, depending on the size of boost dryer 70, web 38 may be creped on the surface of boost dryer 70, thereby eliminating the need for Yankee dryer 52.

Figure 8:
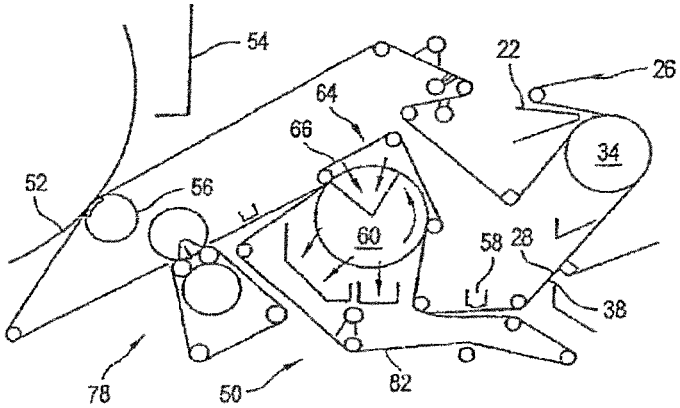
FIG. 8 illustrates a schematic cross-sectional view of another embodiment of an ATMOS™ papermaking machine.

Referring to FIG. 8, there is shown yet another embodiment of the present invention substantially similar to the invention disclosed in FIG. 5 but with an addition of an air press 78, which is a four roll cluster press that is used with high temperature air and is referred to as a High Pressure Through Air Dryer (HPTAD) for additional web drying prior to the transfer of web 38 to Yankee dryer 52. Four-roll cluster press 78 includes a main roll, a vented roll, and two cap rolls. The purpose of this cluster press is to provide a sealed chamber that is capable of being pressurized. The pressure chamber contains high temperature air, for example, 150° C. or higher and is at a significantly higher pressure than conventional TAD technology, for example, greater than 1.5 psi resulting in a much higher drying rate than a conventional TAD. The high-pressure hot air passes through an optional air dispersion fabric, through web 38 and fabric structured 28 into a vent roll. The air dispersion fabric may prevent web 38 from following one of the cap rolls. The air dispersion fabric is very open, having a permeability that equals or exceeds that of fabric structured 28. The drying rate of the HPTAD depends on the solids content of web 38 as it enters the HPTAD. The preferred drying rate is at least 500 kg/hr $m^2$, which is a rate of at least twice that of conventional TAD machines.

Advantages of the HPTAD process are in the areas of improved sheet dewatering without a significant loss in sheet quality and compactness in size and energy efficiency. Additionally, it enables higher pre-Yankee solids, which increase the speed potential of the invention. Further, the compact size of the HPTAD allows for easy retrofitting to an existing machine. The compact size of the HPTAD and the fact that it is a closed system means that it can be easily insulated and optimized as a unit to increase energy efficiency.

Figure 9:
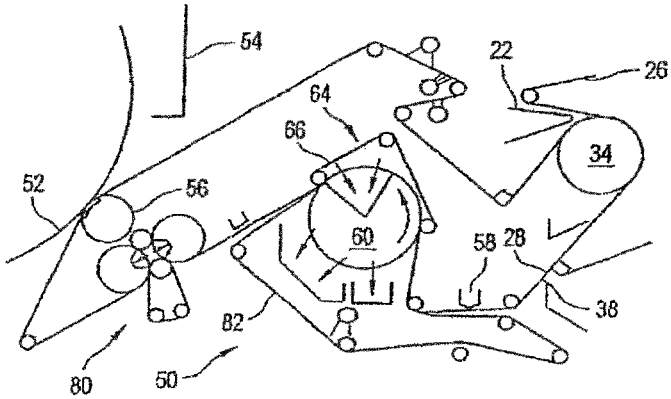
FIG. 9 illustrates a schematic cross-sectional view of another embodiment of an ATMOS™ papermaking machine.

Referring to FIG. 9, there is shown another embodiment of the present invention. This is significantly similar to the embodiments shown in FIGS. 5 and 8 except for the addition of a two-pass HPTAD 80. In this case, two vented rolls are used to double the dwell time of structured web 38 relative to the design shown in FIG. 8. An optional coarse mesh fabric may be used as in the previous embodiment. Hot pressurized air passes through web 38 carried on structured fabric 28 and onto the two vent rolls. It has been shown that depending on the configuration and size of the HPTAD, more than one HPTAD can be placed in series, which can eliminate the need for roll 60.

Figure 10:
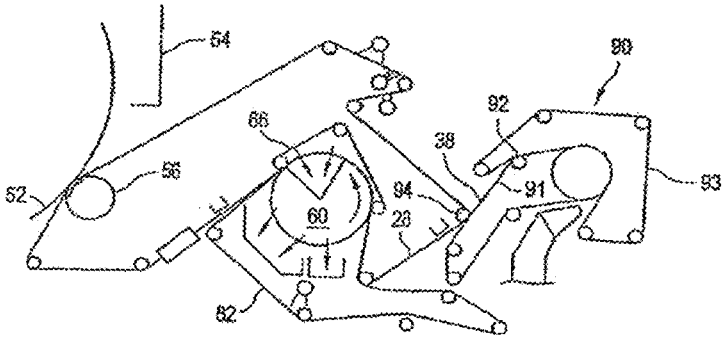
FIG. 10 illustrates a schematic cross-sectional view of another embodiment of an ATMOS™ papermaking machine.

Referring to FIG. 10, a conventional twin wire former 90 may be used to replace the crescent former shown in previous examples. The forming roll can be either a solid or open roll. If an open roll is used, care must be taken to prevent significant dewatering through the structured fabric to avoid losing basis weight in the pillow areas. The outer forming fabric 93 can be either a standard forming fabric or one such as that disclosed in U.S. Pat. No. 6,237,644. The inner fabric 91 should be a structured fabric that is much coarser than the outer forming fabric 90. For example, inner fabric 91 may be similar to structured fabric 28. A vacuum roll 92 may be needed to ensure that the web stays with structured fabric 91 and does not go with outer wire 90. Web 38 is transferred to structured fabric 28 using a vacuum device. The transfer can be a stationary vacuum shoe or a vacuum assisted rotating pick-up roll 94. The second structured fabric 28 is at least the same coarseness and preferably coarser than first structured fabric 91. The process from this point is the same as the process previously discussed in conjunction with FIG. 5. The registration of the web from the first structured fabric to the second structured fabric is not perfect, and as such some pillows will lose some basis weight during the expansion process, thereby losing some of the benefit of the present invention. However, this process option allows for running a differential speed transfer, which has been shown to improve some sheet properties. Any of the arrangements for removing water discussed above as may be used with the twin wire former arrangement and a conventional TAD.

Figure 11:
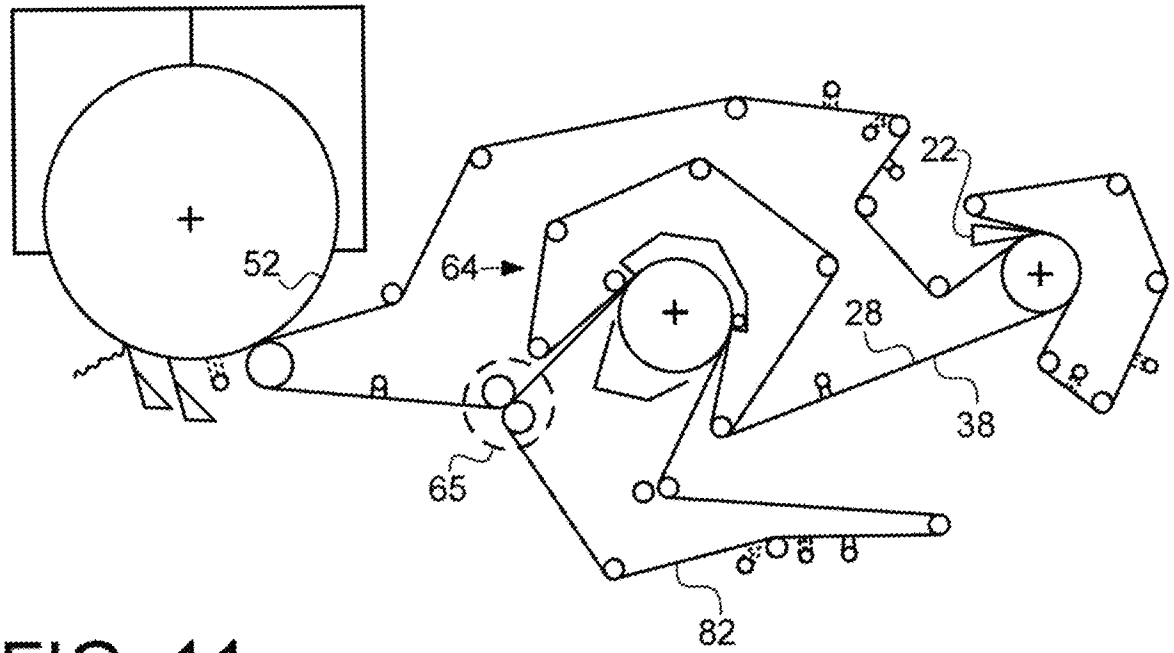
FIG. 11 illustrates a schematic cross-sectional view of another embodiment of an ATMOS™ papermaking machine.

Referring to FIG. 11 there is illustrated another ATMOS™ system having many elements as discussed above. The ATMOS™ system of FIG. 11, is further described in WO 2010/069695 having a priority date of Dec. 19, 2008. Belt press 64 constitutes a first pressing zone where web 38 is pressed. Web 38 proceeds to a second pressing zone 65 where web 38 is pressed again.

Figure 12:
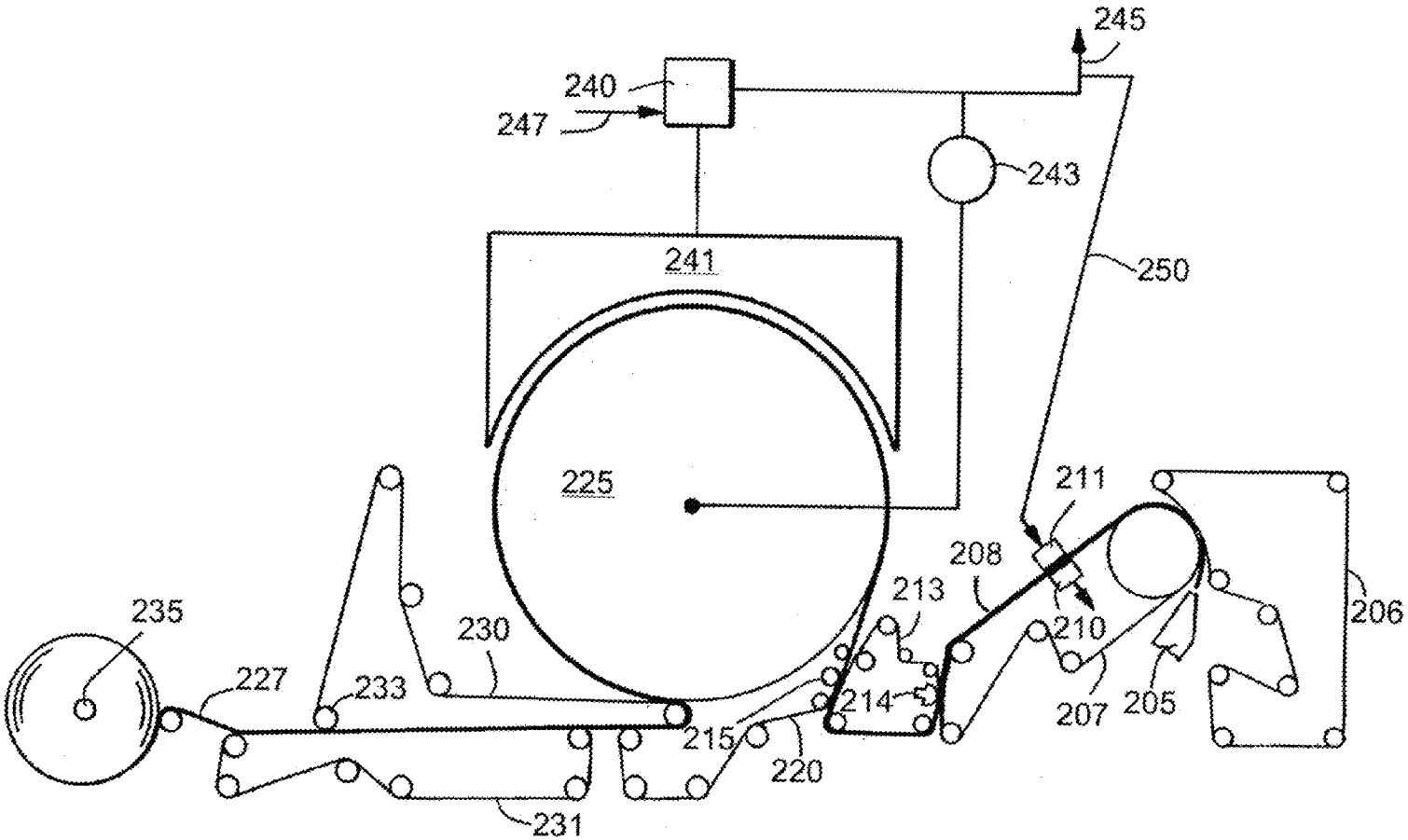
FIG. 12 is a schematic process flow diagram of a throughdrying process in accordance with this invention, illustrating an uncreped throughdrying process with only one throughdryer.
Figure 13:
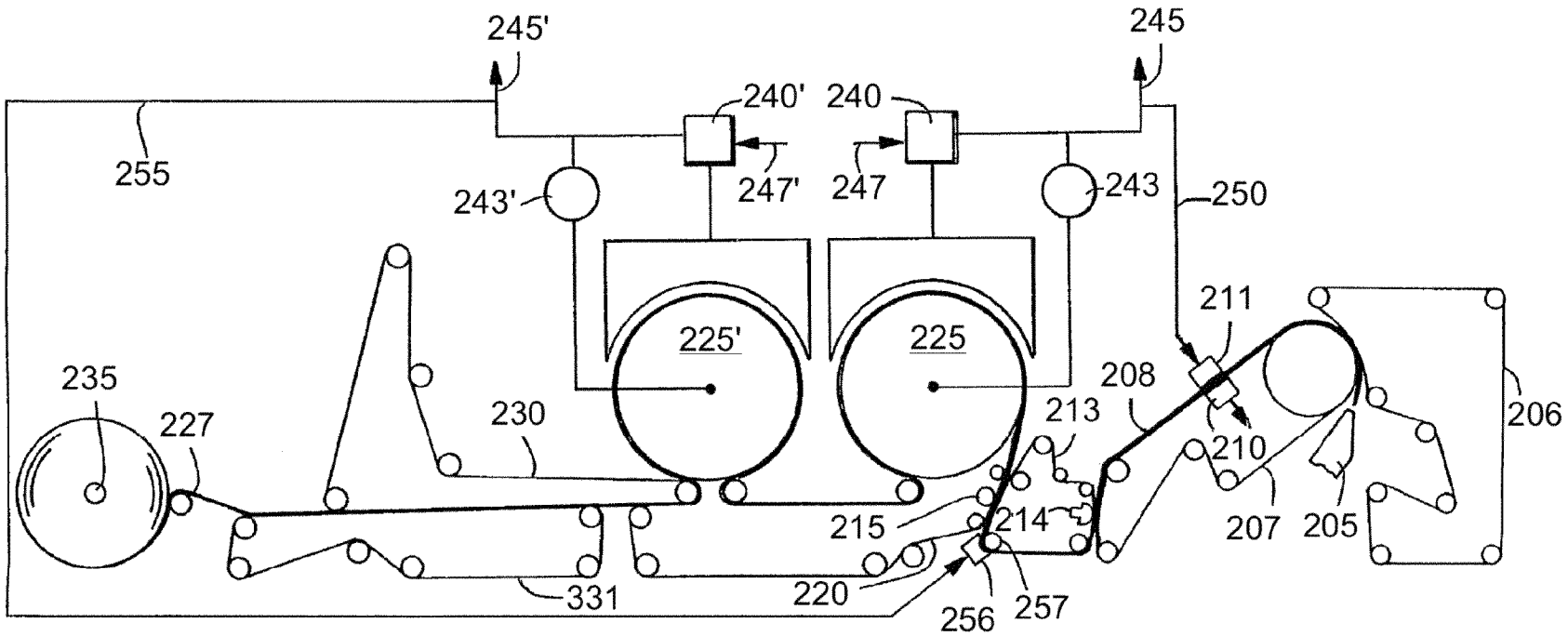
FIG. 13 is a schematic process flow diagram of a throughdrying process in accordance with this invention, illustrating an uncreped throughdrying process having two throughdryers in series.
Figure 14:
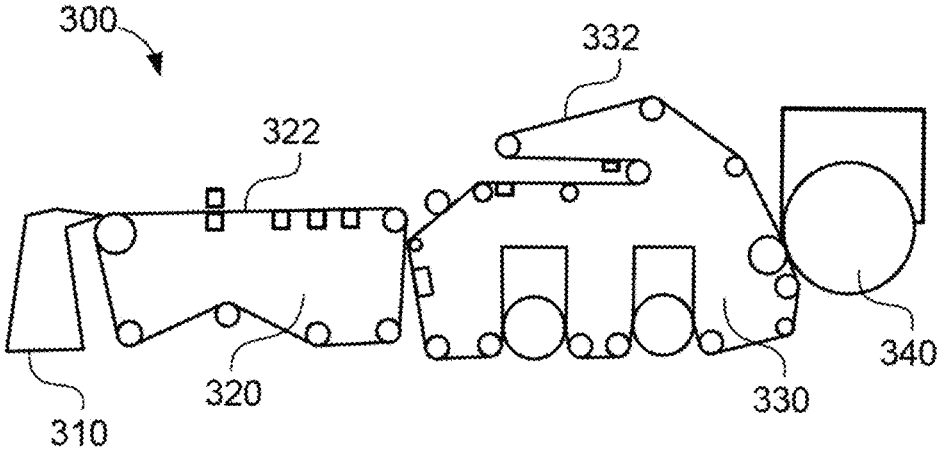
FIG. 14 shows another schematic view of an apparatus for practicing the present invention product and process.

Now, additionally referring to FIGS. 12-14 there are illustrated types of TAD systems, specifically those described in the patent record of Kimberly-Clark (See WO 2005/073461 A1) and Procter & Gamble (See WO 2009/069046 A1). These systems are discussed using various fabrics, of which structured fabric 28, discussed above, may be used in place of the fabrics discussed hereinbelow. FIG. 12 illustrates one of many papermaking processes to which the invention is applicable. Shown is an uncreped through-dried tissue process in which a twin wire former having a layered papermaking headbox 205 injects or deposits a stream of an aqueous suspension of papermaking fibers between two forming fabrics 206 and 207. Forming fabric 207 being the same as structured fabric 28, discussed above. Forming fabric 207 serves to support and carry the newly-formed wet web 208 downstream in the process as the web is partially dewatered to an appropriate consistency, such as about 10% dry weight percent. As shown in this example, profiling of the web in accordance with this invention takes place at the point in the process where the exhaust gas recovery plenum 211 and the vacuum box(es) 210 are positioned. Additional dewatering of the wet web can be carried out, such as by vacuum suction, using one or more steam boxes in conjunction with one or more vacuum suction boxes (not shown) while the wet web is supported by the forming fabric 207.

The wet web 208 is then transferred from the forming fabric 207 to a transfer fabric 213 traveling at a slower speed than the forming fabric 207 in order to impart increased MD stretch into the web. The transfer is carried out to avoid compression of the wet web, preferably with the assistance of a vacuum shoe 214. Although not shown, it is within the scope of this invention for the profiling to take place at any point while the web is supported by the transfer fabric as well as the forming fabric 207.

The web is then transferred from the transfer fabric 213 to the throughdrying fabric 220 with the aid of a vacuum transfer roll 215 or a vacuum transfer shoe. Transfer is preferably carried out with vacuum assistance to ensure deformation of the sheet to conform to the throughdrying fabric, thus yielding desired bulk, flexibility, CD stretch and appearance.

The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric 220, the web is dried to a final consistency, typically about 94 percent or greater, by the throughdryer 225 and thereafter transferred to a carrier fabric 230. The dried basesheet 227 is transported to the reel 235 using carrier fabric 230 and an optional carrier fabric 231. An optional pressurized turning roll 233 can be used to facilitate transfer of the web from carrier fabric 230 to fabric 231. Although not shown, reel calendering or subsequent off-line calendering can be used to improve the smoothness and softness of the basesheet.

The hot air used to dry the web while passing over the throughdryer is provided by a burner 240 and distributed over the surface of the throughdrying drum using a hood 241. The air is drawn through the web into the interior of the throughdrying drum via fan 243 which serves to circulate the air back to the burner. In order to avoid moisture build-up in the system, a portion of the spent air is vented 245, while a proportionate amount of fresh make-up air 247 is fed to the burner. The exhaust gas recycle stream 250 provides exhaust gas to the exhaust gas recovery plenum 211 operatively positioned in the vicinity of one or more vacuum suction boxes 210, such that exhaust gas fed to the exhaust gas recovery plenum is drawn through the web, through the papermaking fabric and into the vacuum box(es) in order to control the consistency profile the web. The humidity of the recycled exhaust gas can be about 0.15 pounds of water vapor or greater per pound of air, more specifically about 0.20 pounds of water vapor or greater per pound of air, and still more specifically about 0.25 pounds of water vapor or greater per pound of air.

FIG. 13 is a schematic process flow diagram of another throughdrying process in accordance with this invention, similar to that illustrated in FIG. 12, but in which two throughdryers are used in series to dry the web. The components of the second throughdryer are given the same reference numbers used for the first throughdryer, but distinguished with a "prime". When two throughdryers are used as shown, the exhaust gas from the first (primary) throughdryer is recycled to the exhaust gas recovery plenum 211 because of its relatively greater heat value. As previously noted, if the throughdryers are operated in such a fashion that the relative heat value of the second throughdryer is greater than the first for the given application, the exhaust gas from the second throughdryer can be used for the recycle stream to the exhaust gas recovery plenum 211.

Optionally, exhaust gas from the second throughdryer can be used to heat and/or profile the dewatered web by providing an exhaust gas recycle stream 255 which, as shown, is directed to exhaust gas recovery plenum 256 opposite vacuum roll or shoe 257. Any of the web-contacting or sheet-contacting rolls in the vicinity of vacuum roll or shoe 257 are also suitable locations for introducing the exhaust gas for purposes of profiling in accordance with this invention should these rolls be equipped with vacuum. As an alternative (not shown), a vacuum box can be placed within the loop of fabric 213 and the plenum 256 can be placed operatively opposite this vacuum box to profile the web.

As described supra, one fibrous structure useful in achieving the fibrous structure paper product of the present invention is the through-air-dried (TAD), differential density structure described in U.S. Pat. No. 4,528,239. Such a structure may be formed according to the nonlimiting embodiment of the apparatus exemplified in FIG. 14. The apparatus 300 includes a head box 310, a Fourdrinier section 320 comprising a Fourdrinier wire 322, a press section 330 comprising a TAD carrier fabric 332, which is the same as structured fabric 28 discussed above and a Yankee Dryer 340.

In one embodiment, it is possible to operate the papermaking machine such that there is a differential velocity between the TAD carrier fabric 332 and the Fourdrinier wire 322 to provide increased fibers in the pillow regions of the fibrous web. The Fourdrinier wire 322 may even run at a higher speed than the TAD carrier fabric 332.

As described supra, it is found that some consumers prefer a relatively bulky product as compared to a relatively cushiony product. It is surprisingly found that in addition to the process/additive changes described supra, in some embodiments during the transfer of the slurry from the Fourdrinier wire to the TAD carrier fabric, if the speed of the Fourdrinier wire and the speed of the TAD carrier fabric are approximately equal, or if the Fourdrinier wire is operating at a relatively slower speed than the TAD carrier fabric, then a relatively high amount of fibers are distributed in the walls of the formed features compared to the formed features of the prior art and a relatively bulky product may be achieved. In other embodiments, the speed of the Fourdrinier wire is from about 0% to about −6% of the TAD carrier fabric (wire-to-press draw of from about 0% to about −6%). One of skill in the art will appreciate that a resin coated belt may be used instead of a TAD carrier fabric.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A papermaking machine for the production of a fibrous web, the papermaking machine, comprising:

a plurality of rollers; and a structured fabric moving along said plurality of rollers, said structured fabric including:

a plurality of weft yarns; and a plurality of warp yarns woven with said plurality of weft yarns to produce a weave pattern, said plurality of warp yarns being a plurality of paired warp yarn sets, each paired warp yarn set including a first warp yarn and a second warp yarn, within said weave pattern said first warp yarn forming a float over at least four weft yarns and weaving with a single weft yarn immediately adjacent to said float, said second warp yarn having an inverse pattern to said first warp yarn, said second warp yarn weaving with a weft yarn that is not adjacent to said single weft yarn with which said first warp yarn is woven, said weave pattern being repeated every ten warp yarns and every ten weft yarns.

2. The papermaking machine of claim 1, wherein said plurality of paired warp yarn sets of said structured fabric include a first paired warp yarn set and an adjacent second paired warp yarn set, said weft yarn that said first warp yarn of said first paired warp yarn set is woven with is adjacent with said weft yarn that said first warp yarn of said second paired warp yarn set weaves.

3. The papermaking machine of claim 1, wherein said first warp yarn has a first diameter and said second warp yarn has a second diameter, said first diameter and said second diameter being approximately the same.

4. The papermaking machine of claim 1, wherein said first warp yarn has a first diameter and said second warp yarn has a second diameter, said first diameter and said second diameter being different.

5. The papermaking machine of claim 1, wherein said first warp yarn has a first diameter and said second warp yarn has a second diameter, said first diameter and said second diameter each being between approximately 0.10 mm and approximately 1.0 mm.

6. The papermaking machine of claim 1, wherein the papermaking machine is one of a TAD system, an ATMOS system, an E-TAD system, and a Metso system.

7. The papermaking machine of claim 1, wherein at least one of said plurality of warp yarns of said weave pattern have a polygonal cross-section.

8. The papermaking machine of claim 1, said first warp yarn floats over four weft yarns and weaves with said single weft yarn, said first warp yarn then floats over four more weft yarns and weaves with an other single weft yarn.

9. The papermaking machine of claim 1, wherein said weave pattern results in pockets, said pockets having a quantity that is between approximately 50/in$^2$ and approximately 500/in$^2$.

10. A structured fabric for use with a papermaking machine for the production of a fibrous web, the structured fabric, comprising:

a plurality of weft yarns; and a plurality of warp yarns woven with said plurality of weft yarns to produce a weave pattern, said plurality of warp yarns being a plurality of paired warp yarn sets, each paired warp yarn set including a first warp yarn and a second warp yarn, within said weave pattern said first warp yarn forming a float over at least four weft yarns and weaving with a single weft yarn immediately adjacent to said float, said second warp yarn having an inverse pattern to said first warp yarn, said second warp yarn weaving with an other single weft yarn that is not adjacent to said single weft yarn with which said first warp yarn is woven, said weave pattern being repeated every ten warp yarns and every ten weft yarns.

11. The structured fabric of claim 10, wherein said plurality of paired warp yarn sets of said structured fabric include a first paired warp yarn set and an adjacent second paired warp yarn set, said weft yarn that said first warp yarn of said first paired warp yarn set is woven with is adjacent with said weft yarn that said first warp yarn of said second paired warp yarn set weaves.

12. The structured fabric of claim 10, wherein said first warp yarn has a first diameter and said second warp yarn has a second diameter, said first diameter and said second diameter being approximately the same.

13. The structured fabric of claim 10, wherein said first warp yarn has a first diameter and said second warp yarn has a second diameter, said first diameter and said second diameter each being between approximately 0.10 mm and approximately 1.0 mm.

14. The structured fabric of claim 10, said first warp yarn floats over four weft yarns and weaves with said single weft yarn, said first warp yarn then floats over four more weft yarns and weaves with said other single weft yarn, said weave pattern being ten of said warp yarns by ten of said weft yarns, said plurality of warp yarns including a third warp yarn, a fourth warp yarn, a fifth warp yarn, a sixth warp yarn, a seventh warp yarn, an eight warp yarn, a ninth warp yarn and a tenth warp yarn, the odd numbered warp yarns having the same weave pattern being offset by one weft yarn from the adjacent odd numbered warp yarn, the even numbered warp yarns having the same weave pattern being offset by one weft yarn from the adjacent even numbered warp yarn.

15. The structured fabric of claim 10, wherein said weave pattern results in pockets, said pockets having a quantity that is between approximately 50/in$^2$ and approximately 500/in$^2$.

16. A structured fabric for use with a papermaking machine for the production of a fibrous web, the structured fabric, comprising:

a plurality of weft yarns; and a plurality of warp yarns woven with said plurality of weft yarns to produce a weave pattern, said plurality of warp yarns being a plurality of paired warp yarn sets, each paired warp yarn set including a first warp yarn and a second warp yarn, within said weave pattern said first warp yarn forming a float over at least four weft yarns and weaving with a single weft yarn immediately adjacent to said float, said second warp yarn having an inverse pattern to said first warp yarn, said second warp yarn weaving with an other single weft yarn that is not adjacent to said single weft yarn with which said first warp yarn is woven, said first warp yarn has a first diameter and said second warp yarn has a second diameter, said first diameter and said second diameter being different.

17. A fibrous web, comprising:

a fibrous construct having at least one formed surface feature, said surface feature including a topographical pattern reflective of a weave pattern in a fabric used in a papermaking machine, the fabric including:

a plurality of weft yarns; and a plurality of warp yarns woven with said plurality of weft yarns to produce a weave pattern, said plurality of warp yarns being a plurality of paired warp yarn sets, each paired warp yarn set including a first warp yarn and a second warp yarn, within said weave pattern said first warp yarn forming a float over at least four weft yarns and weaving with a single weft yarn immediately adjacent with said float, said second warp yarn having an inverse pattern to said first warp yarn, said second warp yarn weaving with another single weft yarn that is not adjacent to said single weft yarn with which said first warp yarn is woven, the web having at least one, preferably all of the following properties:

a basis weight in the range of 17-19.5 gram/m$^2$;

a caliper of 0.45 to 0.49 mm;

a bulk of 22 to 27 cm$^3$/gram; and an absorbency of 15-18 gram of water/gram of paper.

* * * * *